United States Patent [19]

Ishimaru et al.

[11] Patent Number: 4,578,973

[45] Date of Patent: Apr. 1, 1986

[54] PROCESS FOR PRODUCING HOLLOW ALUMINUM EXTRUDATES FOR USE IN A HIGH VACUUM ENVIRONMENT

[75] Inventors: Hajime Ishimaru, Ibaraki; Shigeru Nishizaki, Suita, both of Japan

[73] Assignee: Showa Aluminum Corporation, Osaka, Japan

[21] Appl. No.: 504,955

[22] Filed: Jun. 16, 1983

[51] Int. Cl.[4] ..... B21C 23/00

[52] U.S. Cl. ..... 72/38; 72/253.1; 72/269

[58] Field of Search ..... 72/38, 39, 253.1, 254, 72/255, 258, 265, 269, 271

[56] References Cited

U.S. PATENT DOCUMENTS

| | | | |
|---|---|---|---|
| 3,243,984 | 4/1966 | Hoffmann et al. | 72/265 X |
| 3,808,865 | 5/1974 | Wagner et al. | 72/269 |
| 4,165,625 | 8/1979 | Wagner et al. | 72/38 |
| 4,165,627 | 8/1979 | Boshold | 72/265 X |
| 4,316,373 | 2/1982 | Zilges et al. | 72/38 X |

FOREIGN PATENT DOCUMENTS

| | | | |
|---|---|---|---|
| 53-3341 | 2/1978 | Japan | 72/258 |
| 57-91822 | 6/1982 | Japan | 72/253.1 |

*Primary Examiner*—E. Michael Combs

*Attorney, Agent, or Firm*—Armstrong, Nikaido, Marmelstein & Kubovcik

[57] ABSTRACT

A process for producing a hollow aluminum extrudate for use in a vacuum comprising the steps of hermetically closing the forward open end of a hollow shaped material immediately after extrusion, subsequently extruding a predetermined length of shaped material, cutting off the predetermined length of extruded material and hermetically closing the cut end thereof at the same time, and cutting off the closed ends. During extrusion, the inner surface of the hollow portion of the shaped material is substantially held out of contact with the atmosphere to inhibit a hydrous oxide on the inner surface while permitting formation of a compact oxide film thereon.

3 Claims, 4 Drawing Figures

II
II

PROCESS FOR PRODUCING HOLLOW ALUMINUM EXTRUDATES FOR USE IN A HIGH VACUUM ENVIRONMENT

The present invention relates to a process for producing hollow aluminum extrudates for use in a vacuum, and more particularly to a process for producing hollow aluminum extrudates which are used in a high vacuum, such as particle accelerating pipes for synchrotrons and like accelerators.

The term "aluminum" as used herein includes aluminum and its alloys.

While pipes of this type for accelerating particles are chiefly made of stainless steel, aluminum has recently been found to be suited to this application and therefore introduced into use because aluminum has advantages over stainless steel. For example, aluminum is less likely to induce radioactivity, permits radioactivity to attenuate more rapidly if induced, is superior in thermal conductivity and electroconductivity, has a surface of lower outgassing rate and is lighter and more amenable to processing. The interior of the particle accelerating pipe through which particles are to be passed at a high velocity must be maintained at a high vacuum, so that how to evacuate the pipe to a high degree of vacuum is an important problem.

To evacuate the particle accelerating pipe, the inner surface of the pipe is usually degreased with an organic solvent or the like and thereafter repeatedly subjected to an outgassing treatment which is conducted at about 150° C. for about 24 hours. In combination with this treatment, the pipe inner surface is also subjected to a discharge cleaning treatment in hydrogen gas, argon gas, oxygen gas or the like. However, the procedure requires a long period of time, is inefficient and still remains to be improved in respect of the degree of vacuum.

To maintain a high degree of vacuum within the particle accelerating pipe, it is critical to decrease the quantities of gases to be released from the inner wall of the pipe after the pipe has been finished as a product. We have conducted experimental research on this point and found that the state of the coating on the inner surface of aluminum pipes influences greatly on the degree of vacuum.

As is well known, aluminum is highly susceptible to oxidation and forms an oxide coating on the surface upon contact with oxygen. Further when allowed to stand in the presence of water or moisture, a hydrous oxide film forms on the surface. The higher the temperature of the reaction of forming the hydrous oxide, the more pronounced is the growth of the hydrous oxide film. In an environment of high temperature, a boemite, bialite or like hydrous oxide film is formed. Unlike the aluminum oxide film which is formed in the absence of water, the hydrous oxide film is very coarse and porous with pores of comlex forms. In addition, the hydrous oxide film is thick.

When aluminum pipes are formed by the usual process of extrusion, a hydrous oxide film is formed on the inner surface of the pipe by contact with the atmosphere which contains water. The film has an increased thickness because aluminum is exposed during extrusion to a high temperature which accelerates the reaction of forming the hydrous oxide film. The hydrous oxide film, which has the above-mentioned characteristics and a large thickness, adsorbs a large quantity of water.

Moreover, since the film is not compact, the film over the extrudate obtained further adsorbs water, hydrocarbons, carbon dioxide, carbon monoxide and like substances which are contained in the atmosphere and which act to reduce the degree of vacuum attainable. Such substances are not completely removed by the above-mentioned discharge cleaning treatment in a gas or evacuation procedure but partly remain adsorbed to the film. The hydrous oxide film does not merely adsorb these substances but occlude them because the film has the foregoing characteristics, with the result that they are difficult to remove even by the evacuation procedure. Thus the substances prevent establishment of a high vacuum within the particle accelerating pipe. Furthermore the aluminum pipe as extruded is heated to a high temperature and thereafter cooled in water or air for hardening, whereby improved mechanical strength is given to the pipe. The hydrous oxide film formed during the extrusion further grows during this treatment, while the vacuum reducing substances already adsorbed are occluded in the film.

An object of the present invention is to overcome the foregoing problems and to provide a process for producing hollow aluminum extrudates for use in a vacuum, for example, as particle accelerating pipes which must be internally maintained at a high vacuum.

The present invention provides a process for producing a hollow aluminum extrudate for use in a vacuum characterized by hermetically closing the forward open end of a hollow shaped material immediately after extrusion, cutting the shaped material after a predetermined length thereof has been subsequently extruded and hermetically closing the cut end at the same time, and cutting off the closed ends. With this process, the inner surface of the hollow portion of the shaped material is substantially held out of contact with the atmosphere during extrusion, consequently inhibiting the undesired hydrous oxide to be otherwise formed on the inner surface but permitting formation of an oxide film instead. The oxide film, which is compact and thin, is much less likely to adsorb or occlude vacuum reducing substances than the hydrous oxide film. Such substances, even if adsorbed or occluded, are easily removable by an outgassing treatment. Accordingly the extrudate, i.e., pipe, can be maintained at a high degree of vacuum, with greatly reduced quantities only of objectionable substances released from the inner surface of the pipe. This serves to eliminate, or reduce the amount of, the cumbersome procedure which is conventionally needed for giving an improved degree of vacuum. The hollow extrudates obtained by the process of the present invention are useful not only as particle accelerating pipes but also as shaped materials which need to be maintained at a high vacuum.

After the forward open end of the shaped material has been hermetically closed, it is more preferable to evacuate the hollow portion of the shaped material concurrently with extrusion than to merely continue the extruding operation. Instead of the evacuation, an inert gas alone or a mixture of oxygen and inert gas may be supplied to the hollow portion from the start of extrusion of the shaped material. In the latter case, it is suitable that the mixture comprise 0.5 to 30 vol. %, preferably 1 to 10 vol. %, of oxygen and the balance an inert gas. Useful inert gases are usually argon and helium. In view of extrudability and mechanical strength, preferable materials for the extrudate are AA6061, AA6063 and like Al-Mg-Si alloys. The closed opposite ends may be cut off before or after the hollow extrudate is sent to the site where it is to be used.

If the hollow portion is not evacuated or no inert gas is supplied thereto during extrusion, a small amount of air will flow into the shaped material before it is hermetically closed at its forward open end, but the resulting extrudate has a substantial vacuum. Even when the hollow portion is evacuated or when an inert gas is supplied thereto, the hollow portion contains such an amount of oxygen as to form a compact oxide film.

When the mixture of oxygen and inert gas in the above-mentioned ratio is supplied to the hollow portion of the shaped material, the oxide film formed is about 20 to about 30 Å in thickness. If the other methods are resorted to, the film thickness is of course considerably smaller. Accordingly in the case where the extrudate is allowed to stand in the atmosphere for a long period of time after having its closed opposite ends cut off, the oxide film grows until an equilibrium is reached in the atmospheric environment, consequently permitting formation of a coarse hydrous oxide film over the compact oxide film which has been formed in the nonoxidizing environment. The conjoint presence of the two films is then likely to result in a slightly impaired vacuum performance. In such a case, it is desirable to use the method of supplying the gas mixture to the hollow portion of the shaped material.

For illustrative purposes, the present invention will be described below in greater detail with reference to the accompanying drawings, in which.

Figures 1, 2, 3, 4:
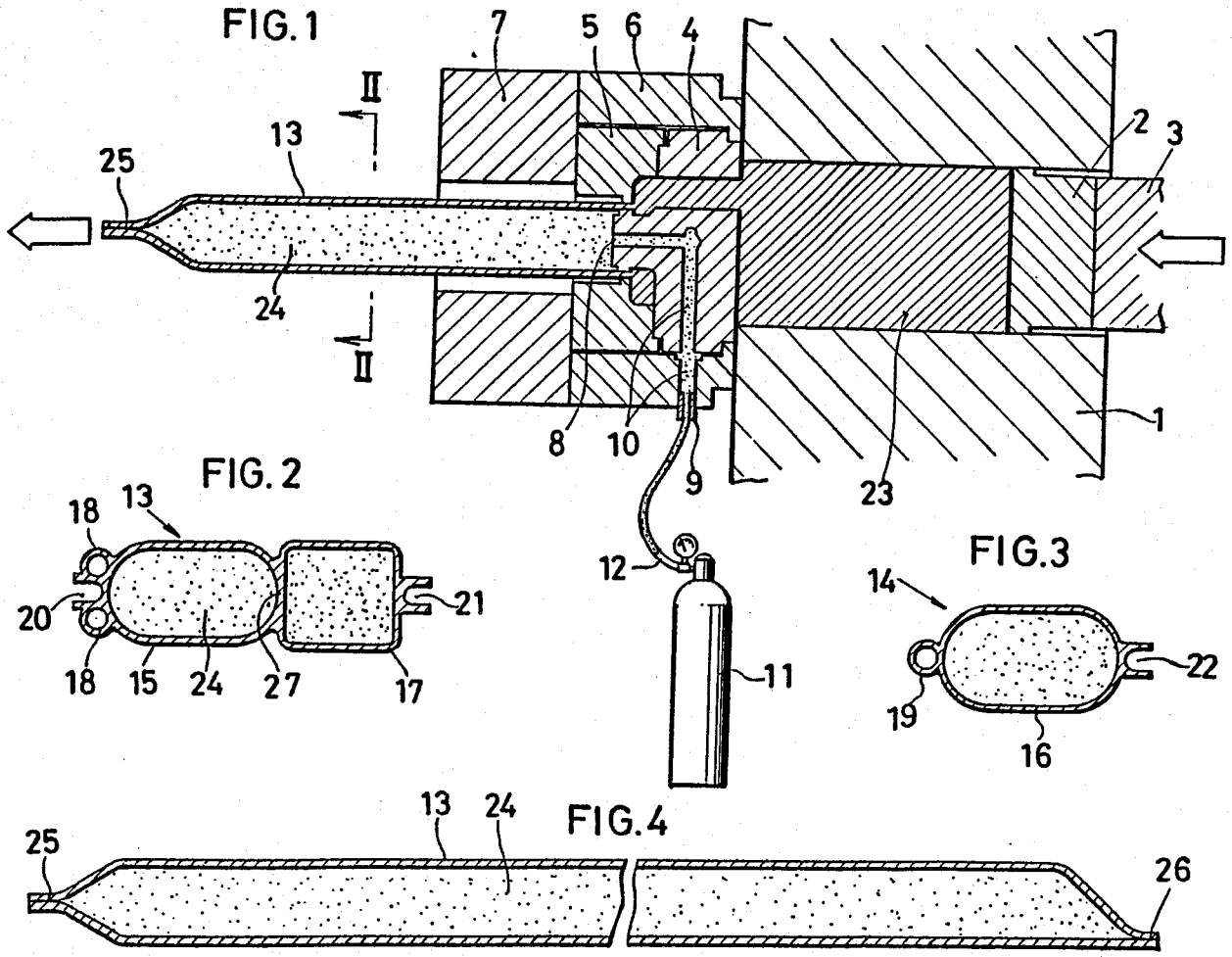
FIG. 1 is a view in longitudinal section showing a hollow aluminum extrudate while it is being produced.
FIG. 2 is an enlarged view in section taken along the line II—II in FIG. 1.
FIG. 3 is a sectional view corresponding to FIG. 2 and showing another extrudate which is used in combination with the extrudate of FIG. 2 for preparing a particle accelerating pipe.
FIG. 4 is a view in longitudinal section showing the extrudate with a gas mixture hermetically enclosed therein.

FIG. 1 shows an extruder which includes a known container 1, dummy block 2, stem 3, porthole male die 4, porthole female die 5, die holder 6 and bolster 7. The male die 4 is centrally formed with a gas injection outlet 8. A gas channel 10 extending from a gas inlet 9 in the lower end of the die holder 6 to the outlet 8 is formed in the male die 4 and the die holder 6. The free end of a hose 12 attached to a gas container 11 is connected to the gas inlet 9. Hollow extrudates 13 and 14 as shown in FIGS. 2 and 3 in cross section for preparing a particle accelerating pipe are produced by the extruder. The die assemblies for producing the extrudates 13 and 14 are of course each in conformity with the shape of the extrudate to be obtained. Extrudates 13 and 14 of predetermined length are connected to one another alternately into an endless pipe (not shown) for accelerating particles.

The extrudates 13 and 14 respectively have particle passing hollow portions 15 and 16 which are elliptical in cross section. The extrudate 13 includes an evacuating hollow portion 17 adjacent the hollow portion 15. The hollow portions 15 and 17 are separated by a partition 27 which has communicating ports at a predetermined spacing. The extrudate 13 is provided with two cooling water channels 18 on one side of the particle passing portion 15, while the other extrudate 16 is formed with a cooling water channel 19 on one side of its hollow portion 16. The water channels 18 and 19 have a small circular cross section. The extrudate 13 has grooves 20 and 21 for installing therein a sheathed heater wire for outgassing the extrudate, between the two water channels 18 and on one side of the evacuating hollow portion 17. The other extrudate 14 has a similar groove 22 on the other side of its hollow portion 16.

The hollow extrudate 13 is produced by the following steps. First, the dies are cleaned with a caustic agent, and a billet 23 of AA6063 homogenized at 560° for 3 hours is extruded at a temperature of 500° C. at a speed of 10 m/min without using any lubricant. Simultaneously with the extrusion, a gas mixture 24 of 7 vol. % of oxygen and argon, the balance, is injected at a pressure of 2 to 3 kg/cm$^2$ into the hollow portions of the shaped material 13 being extruded, from the container 11 via the hose 12, the channel 10 and the outlet 8. After a short length of material 13 has been extruded, the forward open end thereof is hermetically closed by a press to form a closed end portion 25 shown in FIG. 1. After a predetermined length has been extruded with continued supply of the gas mixture 24, the shaped material 13 is cut by a shear, and at the same time, the cut end of the length is hermetically closed to form the other closed end 26. The shaped material 13 is thereafter forcedly cooled in air to 250° C. with the gas mixture 24 enclosed therein, then spontaneously cooled and thereafter subjected to tension for correction. Subsequently the resulting shaped material is aged at 180° C. for 6 hours. Finally the closed ends 25 and 26 of the material 13 are cut off without using any oil and air blow to obtain a hollow extrudate of predetermined size. The other hollow extrudate 14 is produced in the same manner as above except that different dies are used.

The extrudate has a compact and thin oxide film on its inner surface. When the extrudate was outgassed at 150° C. for 24 hours and then checked for the degree of vacuum, the outgassing rate achieved was up to $10^{-13}$ torr·l/s·cm$^2$. This is attributable to a totally unexpected phenomenon, i.e. to the characteristics of the inner oxide film that the film functions as a vacuum pump to adsorb the gasses remaining in the interior of the extrudate.

What is claimed is:

1. A process for producing a hollow aluminum extrudate for use in a high vacuum environment comprising the steps of:

hermetically closing the forward open end of a hollow shaped material immediately after extrusion;

cutting the shaped material after a predetermined length thereof has been subsequently extruded and hermetically closing the cut end at the same time;

cutting off the closed ends; and supplying a mixture of oxygen and an inert gas to the hollow portion of the shaped material from the start of extrusion to maintain the inner surface of the hollow portion of the shaped material substantially out of contact with the atmosphere during extrusion to effect the formation of only a compact and thin oxide film which is less likely to absorb or occlude vacuum reducing substances.

2. A process as defined in claim 1 wherein the mixture comprises 0.5 to 30 vol. % of oxygen and the balance an inert gas.

3. A process as defined in claim 1 wherein the mixture comprises 1 to 10 vol. % of oxygen and the balance an inert gas.

* * * * *